United States Patent [19]

McAvoy

[11] 4,437,271

[45] Mar. 20, 1984

[54] SURFACE TREATING PAD HAVING A RENEWABLE SURFACE

[75] Inventor: Thomas R. McAvoy, Stillwater, Minn.

[73] Assignee: Minnesota Mining and Manufacturing Company, St. Paul, Minn.

[21] Appl. No.: 20,314

[22] Filed: Mar. 14, 1979

[51] Int. Cl.[3] ..... B24D 11/00

[52] U.S. Cl. ..... 51/400; 51/404; 51/406; 51/359; 15/230.12

[58] Field of Search ..... 15/230.12, 230.15; 51/297, 177, 358, 359, 400, 401, 404, 406

[56] References Cited

U.S. PATENT DOCUMENTS

| | | | |
|---|---|---|---|
| 1,822,856 | 9/1931 | Dirkes | 51/406 |
| 1,896,253 | 2/1933 | Smith | 51/406 X |
| 2,347,210 | 4/1944 | Meeker | 51/406 |
| 2,485,295 | 10/1949 | Larson | 51/406 X |
| 2,626,489 | 1/1953 | Thompson | 51/359 |
| 3,527,001 | 9/1970 | Kleemeir et al. | 51/358 |
| 3,703,739 | 11/1972 | Young et al. | 51/406 X |

*Primary Examiner*—Frederick R. Schmidt
*Assistant Examiner*—Robert P. Olszewskil
*Attorney, Agent, or Firm*—Donald M. Sell; James A. Smith; Richard Francis

[57] ABSTRACT

A surface treating pad having a renewable working surface comprises a base layer upon which is removably fastened at least one unitary stack comprising a plurality of thin layers of lofty nonwoven abrasive material. The layers on the stack are removably fastened together and to the base layer so that individual layers may be easily separated from the stack or from the base layer to expose a fresh surface treating working face without damage to the remainder of the pad. The pads are particularly suited for treating floors.

6 Claims, 3 Drawing Figures

SURFACE TREATING PAD HAVING A RENEWABLE SURFACE

BACKGROUND OF THE INVENTION

1. Field of the Invention

This invention relates to surface treating pads, and, more specifically, to a novel layered treating pad of lofty low-density abrasive product having a plurality of renewable working surfaces.

2. Prior Art

The low-density abrasive products of the type defined in U.S. Pat. No. 2,958,593 and sold under the registered trademark "Scotch-Brite" by the 3M Company of St. Paul, MN. have found great commercial success in use as floor treating pads. This type of abrasive product is typically formed of crimped staple fibers which have been formed into a mat and impregnated with resinous binder and abrasive. The pads are available in any of a wide variety of types to provide many functions. Some pads are extremely abrasive and are desirably used for wax stripping and cleaning floor surfaces which are heavily encrusted with soil. Others are mildly abrasive and are typically used for floor polishing, with or without the prior application of wax.

The pads of this type are typically cut in a circular shape to be used in conjunction with a floor polishing machine. The pads may also be rectangular or of other shapes depending upon the equipment with which they are to be used. Such machines have a means for engaging or holding a pad thereon while rotating the pad against the surface being treated. One highly commercially successful engaging means is that described by Kleemeier et al is U.S. Pat. No. 3,527,001.

When used, such pads become soiled on their working surfaces, either with soil removed from the surface being treated or because of a wax build-up on the working surface of the pad, if the floor pad is used in a spray cleaning operation, or a combination of these. Spray cleaning involves applying (e.g., by spraying with an aerosol or mechanical sprayer) small amounts of liquid cleaner-polish composition on the floor followed by passing the machine fitted with the pad over the applied liquid to cause cleaning, drying and polishing. After one side of the pad becomes soiled it is customary to merely invert the pad and use the opposite side which is typically of the same construction as the first side until it too becomes soiled.

Thereafter, the pad is either discarded or attempts are made to rejuvenate it. Rejuvenation has been accomplished by washing the pad in a washing machine or by merely flushing out the debris of pad with high pressure fluids. Washing is not desirable since it weakens the pad and changes its performance. Flushing is also not completely desirable since it does not remove all of the debris and the pad will not perform after flushing for the same length of time or in the same manner as a new pad.

SUMMARY OF THE INVENTION

The present invention provides a layered surface treating pad having a renewable working surface. The pad of the invention comprises, in combination, a base layer and at least one unitary stack comprising a plurality of thin layers of lofty nonwoven abrasive material suited for use in treating surfaces, e.g., floors. The thin layers of lofty nonwoven abrasive material are removably fastened to at least one flat face of the base layer and to each other in the stack to provide a unitary layered structure which is capable of maintaining such unity during use and yet which permits each thin layer to be easily separated therefrom to expose a fresh treating surface of the next layer, when desired, without damage to the remainder of the pad.

One preferred embodiment of the treating pad of the invention has a stack of thin layers removably fastened to both the top flat face and to the bottom flat face of the base layer. Another preferred embodiment of the treating pad of the invention includes only one stack of thin layers adhered to the bottom flat face of the base layer which most preferably has at least its top flat face marked to distinguish it from the working surface of the pad.

Fastening may be by any conventional means which provide for the temporary attachment of the layers during and permits removal of individual layers after use. The most preferred means of removably fastening the layers together and the stack to the base layer is by means of an adhesive binder applied to that surface of each of the thin layers which faces toward the base layer. The adhesive is selected and applied so that it will be retained on the surface of the layer to which it was applied and so that it will not leave any significant residue upon the surface to which each layer is adhered, upon removal. Other fastening means are hereinafter disclosed.

DRAWING

The invention may be further understood by reference to the accompanying drawing, wherein like parts are indicated by similar reference numerals throughout the several views and wherein.

DETAILED DESCRIPTION

Figure 1:
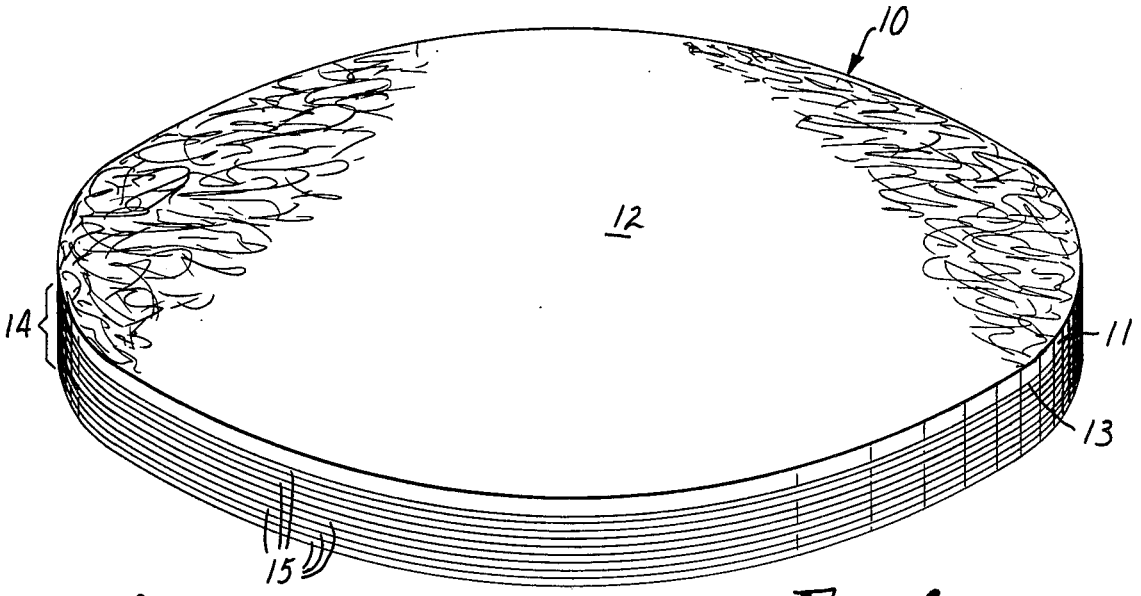
FIG. 1 is a perspective view of one emboidment of a surface treating pad in accordance with the present invention.
Figure 2:
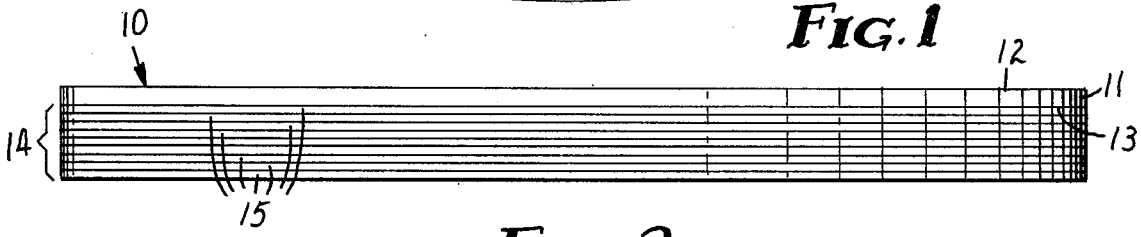
FIG. 2 is a side view of the pad shown in FIG. 1.

Referring to FIGS. 1 and 2 of the drawing, a surface treating pad according to the present invention in the form of a disc 10 is shown having a base layer 11 which has a top substantially flat face 12 and a bottom substantailly flat face 13 and stack 14 consisting of thin removably fastened together layers 15 of lofty nonwoven abrasive material removably fastened to bottom face 13.

FIG. 2 shows another embodiment of a pad of the invention in pad 20 which has a base layer 21 and stacks 22 and 23 consisting of removably fastened together layers 24 of lofty low-density abrasive material, with one stack removably fastened to each face of base layer 21. The top removable layer **24*a*** is shown in a partially removed position.

The base layer is required in the pad of the invention to provide a sufficiently thick pad residue which will remain after removal of all or most of the lofty nonwoven abrasive layers, as they become soiled. Several thin, lofty nonwoven abrasive layers may provide the base layer, but the preferred pad has a thicker base layer. If the pad were composed entirely of the thin layers of lofty nonwoven abrasive material, the last few layers would generally be unuseable since they would be too thin to use on conventional floor treating machines. Such conventional machines have engaging means which typically protrude into the floor treating pad to retain the pad on the machine during use. If such protrusions extend through the layer of lofty nonwoven abrasive materials they may mar the floor being treated and would also likely interfere with the performance of the abrasive material against the floor. Therefore, a base layer preferably is at least about 3 mm thick to avoid this situation. Typically, the base layer will be about 3 mm to about 13 mm thick, preferably about 3 mm to about 10 mm. The base layer should not be so thick so as to add unnecessary thickness to the pad, resulting in an unduly thick pad after the addition of the removable thin layers. The maximum thickness of the pad is typically dictated by the particular machine employed and generally does not go beyond 75 mm thick.

The base layer may be composed of any suitable material upon which the removable layers of lofty nonwoven abrasive material may be fastened which permits engagement by the appropriate engaging means of the floor polishing machine. The base layer may be formed of felt, fibrous pads, mats of bonded crimped staple fibers, or lofty mats of nonwoven abrasive material. The preferred material for forming the base layer is a lofty nonwoven abrasive material which is a similar composition as the removable layers, thus providing a last renewed surface of the same construction as the removable thin layers, after the last layer is removed.

The thin removable layers of lofty nonwoven abrasive material will have a thickness on the order of about 0.5 mm to about 20 mm, preferably from about 1 mm to about 5 mm. Typically, the number of layers of nonwoven material will be at least 3, otherwise it is generally not economical to produce a layered pad. The number of layers should not be so great as to make the pad unduly thick for the reasons stated above. Typically, the number of layers will be on the order of 5 to about 20.

No particular modification of the lofty nonwoven abrasive material presently employed for treating floors is needed, other than producing it in the desired thickness. The product specifications of such lofty nonwoven abrasive material is well known in the floor treating art. The method of producing the loft nonwoven abrasive material of the invention is well described in assignee's U.S. Pat. No. 2,958,593, the disclosure of which is incorporated herein by reference for such teaching.

A means of removably fastening the layers in the stack together and the stack to the base layer may include any of a wide variety of known fastening means. Suitable fastening means include adhesive bonding, e.g., by the application of adhesive films, either as a solid self-supporting layer of adhesive material or as adhesive coatings on either side of a backing layer, or by bonding or application of a coatable adhesive composition, ultrasonic/welding, flame bonding, mechanical means such as threads, hooks, staples, and the like. It should be noted that the use of adhesive films provides a particular advantage in that it does not permit migration of soil and other residues generated in cleaning through the layer being used to the unused layers of the treating pad.

The most preferred fastening means is by the application of a suitable coatable adhesive at the interface of the layers to be fastened together, taking care that the adhesive is applied to the surface of the layer which will not become the treating surface. In that case, the adhesive should be such that it will be substantially retained on the surface of the layer to which it is applied and, upon removal, it will not leave any significant residue upon the surface to which the layer is adhered. If the adhesive separates or splits at the interface, it should be selected so that the residue will not interfere with the performance of the pad. The adhesive should also permit easy removal of each layer, when desired, without destruction of the remainder of the pad or any other adverse effect upon the newly exposed treating surface.

The materials employed in the treating pad of the invention should, of course, be compatible for use in typical cleaning operations where, for example, detergent-containing aqueous solutions, waxing solutions and cleaning compositions are often used. The materials should be capable of withstanding some minor heat build-up as may be generated by the rotation or other movement of the pad against the surface being treated.

The pad of the invention may be made by fastening together large sheets of the appropriate materials to form a laminated structure which then can be die cut to produce the desired shapes. The layers are generally compacted together to provide a compression of approximately 10 to 80 percent during the fastening step. Die cutting may be accomplished by use of conventional die cutting equipment such as a circular blade of the appropriate diameter. The pad of the invention may be made in any convenient diameter such as are typically employed for use in conventional rotary floor treating machines and for other machines which employ rotating pads of this type.

The layers of lofty low-density abrasive product should be capable of being removed individually from the stack without damage to the pad. That is, the layer should peel away from the stack to expose the next underlying layer without causing any other layers to become delaminated or to disintegrate. The layer should be sufficiently fastened together, however, to prevent them from being displaced as they are rotated in use in a machine. Additionally, the layers should remain when the pad is handled, for example, in removing the pad from a shipping carton and placing it on the machine.

Adhesive materials which have been found to be particularly suitable for use in fastening the layers of the pad of the invention together are conveniently applied by converting them to a liquid state, e.g., by melting or by mixing with a suitable compatible solvent, and coating them, using conventional coating techniques over one surface of a large sheet of the thin, lofty low-density abrasive product. Suitable coating techniques for such adhesive compositions include spray coating, dip coating, roll coating, e.g., using rotogravure rolls, and the like. The layers are then pressed together and permitted to dry, die cut into the appropriate shape and are ready for use.

Suitable adhesive compositions for this purpose include urea-formaldehyde resins, phenol-formaldehyde resins, epoxide resins, polyurethane resins, and acrylate resins. A particularly satisfactory adhesive composition is provided by a 60:37:3 styrene -2- ethyl hexyl acrylate - acrylic acid terypolymer which may be dissolved in an aromatic solvent such as toluene to provide a coatable solution. A satisfactory coatable solution having a Brookfield viscosity of 20,000 cps is provided by a 65.8 weight percent solution of the terpolymer in toluene. Other adhesive compositions which will hold the layers together and permit release, when desired, will also be useful.

Adequate adhesion between layers for maintaining the integrity of the pad in use and permitting release when desired will be possible if the force required to delaminate the layers is on the order of 9 to 450 grams per 25 mm width. This force may be conveniently measured by pulling the layers apart, for example, by placing one segment of laminate in one jaw of an Instron tensile testing device and the other layer in the other jaw and pulling the two layers apart at an angle of 180°.

If the force is less than about 9 grams per 25 mm width, the layers may not remain laminated together during use. If the force is greater than about 450 grams per 25 mm width, adhesion between layers may exceed the cohesive strength of the layer and one or more layers may suffer internal failure as removal is attempted. The force values are, of course, a function of the cohesive strength of the layers and, for a layer with a higher cohesive strength, the maximum adhesion may exceed 450 grams per 25 mm width.

The amount of adhesive applied to the surface of the lofty nonwoven abrasive material will be sufficient to provide proper binding as described above yet permit separation of layers, where desired. The amount of adhesive will typically vary between about 0.5 mg/cm$^2$ to 20 mg/cm$^2$.

A light compaction, at least to hold individual layers in contact with one another during adhesion, may be necessary. Increased pressure is used when permanent compaction is desired. Pressure combined with heat results in a compressed pad which can retain the thickness to which it has been compressed.

Various modifications may be made in the pad of the invention. For example, where the pad comprises a single stack of removable nonwoven abrasive layers bonded to only one side of the base layer, such as depicted by FIGS. 1 and 2, it may be convenient to mark the top of the base layer as the first working face of the stack of layers to distinguish the two sides of the pad so that a user will not be confused and commence use of the pad with the top surface of the base layer on the floor. For this purpose, it may be desirable to print "top" on the top or "bottom" on the bottom or some similar designation. Alternatively the entire base layer or its top surface may be colored differently from the thinner nonwoven abrasive layers. It may also be convenient to have alternate nonwoven abrasive layers of a different color, e.g., the uneven numbered layers are of one color such as red and the even numbered layers another color such as white, so that the user would not mistakenly remove two layers at once. Additionally, alternate nonwoven abrasive layers may be of different abrasiveness. For example, the odd numbered layers may be of a coarser abrasive grade for wax removal and the even numbered layers may be of a finer abrasive grade for polishing. Other modifications are also possible.

EXAMPLES

The invention is further illustrated by the following examples, wherein all parts are by weight unless otherwise specified.

The specific components of Examples 1–10 are described in Tables 1 and 2. The base layer in each of the examples was a nonwoven web having the same composition as the thin removable layers. The nonwoven webs were formed of a web of crimped fibers employing a "Rando Webber" web forming machine, roll coating the web with the designated prebonding resin, curing the prebonding resin by passing the coated web through a forced air oven heated at a temperature in the range of about 125° C. to about 160° C. with a residence time of approximately 3 to 10 minutes. The coated web was then passed under a spraying device where the working face of the web was spray coated with the designated top coating and then passed into a forced air oven for curing at a temperature between 125° C. and 160° C. for a residence time of 6 to 10 minutes. After the top coating has been applied and cured, a layer to layer bonding resin or bonding material was applied. Such application was either by roll coating or by spray coating, but in all cases, the layer to layer bonding resin was applied to the nonworking face of the layer. In those examples which employed a film or tape bonding layer, the films or tapes were simply laid over the nonworking face of the individual layers. The other layers were then stacked with the adhesive coated sides facing toward the base layer, the stack placed between two aluminium plates and compressed to their final desired thickness by employing bolts deployed in holes located adjacent the corners of each of the plates to compress the stack to the desired thickness, until curing of the adhesive was accomplished.

Certain of the pads prepared were tested for utility under normal working conditions against a conventional solid disc-shaped pad of approximately the same abrasiveness. The conventional test pad was sold by the 3M Company under the trade designation "Scotch-Brite" 51 Line "Red Buffer" pad. This pad normally cleans from about 50 to about 100 square meters, before loading with soil so as to become no longer useful because of adverse effects. Of the pads tested, each layer of the test pads of the examples provided substantially the same utility, when tested under the same conditions.

TABLE 1

| | PAD | | LAYERS | | FIBER | | | | PREBOND RESIN | | TOPCOAT | | LAYER TO LAYER BINDER | |
|---|---|---|---|---|---|---|---|---|---|---|---|---|---|---|
| Example No. | Diameter (cm) | Average Thickness (cm) | Number of Excluding Base | Average Thickness (cm) | Type | Denier | Length (cm) | Average Weight $\left(\frac{mg}{cm^2}\right)$ | Type[3] and Color | Average Weight $\left(\frac{mg}{cm^2}\right)$ | Type[3] and Color | Average Weight $\left(\frac{mg}{cm^2}\right)$ | Type | Average Weight $\left(\frac{mg}{cm^2}\right)$ |
| 1 | 21 | 3.5 | 10 | 0.5 | P[1] | 50 | 5 | 6.3 | A-red | 2.7 | B-red | 2.5 | rubber base adhesive[4] | 0.34 |
| 2 | 30.5 | 2.8 | 9 | 0.3 | " | " | " | 2.1 | " | 0.8 | " | 1.7 | rubber base adhesive[4] | 1.1 |
| 3 | 45.7 | 5 | 20 | 0.8 | " | " | " | 5.2 | C-red | 2.9 | D-red | 3.8 | rubber base adhesive[4] | 1.3 |
| 4 | 9.5 | 2.5 | 6 | 0.8 | " | " | " | 5.2 | " | 2.9 | " | 3.8 | double coated carpet tape | — |
| 5 | 35.6 | 2.5 | 7 | 0.8 | " | " | " | 5.2 | " | 2.9 | " | 3.8 | rubber-base adhesive[4] | 1.7 |
| 6 | 40.6 | 3.8 | 10 | 1.2 | " | 75% 50<br>25% 15 | 5.6<br>3.8 | 8.0 | E-white | 8.2 | F-red | 6.1 | rubber-base adhesive[4] | 1.7 |
| 7 | 40.6 | 4.1 | 10 | 1.1 | N[2] | 75% 50<br>25% 15 | 5.3<br>3.8 | 9.0 | G-white | 3.4 | H-red | 6.5 | rubber-base adhesive[4] | 1.0 |
| 8 | 43 | 3.9 | 10 | 1.1 | P[1] | 75% 50<br>25% 15 | 5.6<br>3.8 | 6.3 | I-gold | 3.2 | J-gold | 6.5 | styrene-2-ethylhexyl acrylate-acylic acid terpolymer | 1.5 |
| | | | | | " | 75% 50<br>25% 15 | 5.6<br>3.8 | 3.4 | E-red | 1.7 | F-red | 5.9 | styrene-2-ethylhexyl acrylate-acrylic acid terpolymer | 1.5 |
| 9 | 21 | 2.5 | 10 | 0.8 | N[2] | 80% 200<br>20% 15 | 5.5<br>3.8 | 8.6 | K-black | 5.7 | L-black | 13.4 | rubber-base adhesive[4] | — |
| 10 | 43 | 2.6 | 10 | 0.4 | P[1] | 75% 50<br>25% 15 | 5.6<br>3.8 | 2.5 | E-white | 1.3 | F-red | 6.7 | rubber-base adhesive[4] | 0.6 |

[1]P = crimped polyester staple;
[2]N = crimped nylon staple;
[3]See Tbl. II for compositions identified "A"-"L"
[4]Tackified divinyl benzene cross-linked styrene butadiene rubber sold under the trade designation "Spray Adhesive No 77" by the 3M Company

TABLE II

| RAW MATERIALS | Prebond (A) | Top Coat (B) | Prebond (C) | Top Coat (D) | Prebond (E) | Top Coat (F) | Prebond (G) | Top Coat (H) | Prebond (I) | Top Coat (J) | Prebond (K) | Top Coat (L) |
|---|---|---|---|---|---|---|---|---|---|---|---|---|
| Xylol | 1.4 | — | — | — | — | — | — | — | 1.36 | — | — | — |
| Saturated Polyester Desmophene 1770 | 1.2 | — | 6.1 | — | 24.1 | — | — | — | 2.4 | — | — | — |
| Trimethylol propane and Glycerol (1:1) | 0.05 | — | 0.25 | — | 1.0 | — | — | — | 0.1 | — | — | — |
| Talc | 0.62 | 1.8 | 3.2 | 3.2 | 12.7 | 18.4 | — | 9.5 | 1.27 | 0.84 | — | — |
| Red pigment solution I (22 parts red pigment: 78 parts vehicle) | 0.064 | — | 0.318 | — | — | — | — | — | — | — | — | — |
| Polyisocynate sold under the trade designation "Mondur" CB-75 | 1.035 | — | 5.2 | — | 21 | — | — | — | 2.1 | — | — | — |
| Antifoam agent | .0004 | — | — | — | — | — | .014 | — | — | — | .245 g | — |
| Silica 400 mesh | .241 | 0.68 | 1.36 | 1.13 | 5.4 | 6.4 | — | 3.2 | 0.54 | 0.317 | — | — |
| Ethyl "Cellosolve" | — | 2.3 | — | 3.9 | — | 9.5 | — | 2.7 | — | 0.95 | — | — |
| Phenolic resin | — | 7.3 | — | — | — | — | — | — | — | 3.72 | 3.5 | 4 |
| Red pigment solution II (10 parts red pigment: 90 parts vehicle) | — | 0.45 | — | 0.68 | — | 8.2 | — | 4.1 | — | — | — | — |
| Ca $CO_3$ | — | 0.9 | — | 1.6 | — | 9.1 | — | 4.5 | — | 0.45 | 0.57 | — |
| "Cellosolve" acetate | — | — | 6.8 | — | 38 | — | — | — | — | — | — | — |
| $AL_2O_3$ (180/600) | — | — | — | — | — | — | — | — | — | — | — | 5.7 |
| Water | — | — | — | 3.2 | — | 31.3 | 9 | 14.5 | — | 0.95 | 1.36 | 1.35 |
| Phenolic resin | — | — | — | 12.3 | — | 74 | 31 | 37.2 | — | — | — | — |
| 10% solution dibutyl-tindilaurate | — | — | — | — | .004 | — | — | — | — | — | — | — |
| Isopropyl alcohol | — | — | — | — | — | — | 2.7 | — | — | — | 0.34 | 0.23 |
| Antifoam agent sold under the trade designation "Eldefoam" | — | — | — | — | — | — | 3 g | — | — | — | — | — |
| Gold pigment - I (3 parts brown:12 parts yellow:85 parts pigment vehicle) | — | — | — | — | — | — | — | — | 127 gm | — | — | — |
| Gold pigment - II (10 parts gold pigment: 90 parts vehicle) | — | — | — | — | — | — | — | — | — | 0.23 | — | — |
| Black dye | — | — | — | — | — | — | — | — | — | — | 0.23 | 0.11 |
| Black pigment | — | — | — | — | — | — | — | — | — | — | 0.11 | — |
| Flint (360 mesh & finer) | — | — | — | — | — | — | — | — | — | — | 2.6 | — |
| $AL_2O_3$ (280 mesh & finer) | — | — | — | — | — | — | — | — | — | — | 2.6 | — |

What is claimed is:

1. A layered surface treating pad having a plurality of renewable working surfaces comprising in combination:
   (1) a base layer which is about 3 mm to about 13 mm thick and which has a top substantially flat face and a bottom substantially flat face; and
   (2) a stack comprising a plurality of thin layers of lofty nonwoven abrasive material adhesively removably fastened to said bottom substantially flat face, each layer of said stack having a thickness in the range of about 0.5 mm to about 20 mm, said layers being adhesively removably fastened to each other in said stack such that a force required to delaminate said layers in use is on the order of 9 to 450 grams per 25 mm width, said base layer and said stack providing a unitary layered pad which is capable of maintaining such unity during use and which permits each thin layer to be easily separated therefrom to expose a fresh treating surface of the next layer, when desired, without damage to the remainder of the pad.

2. The surface treating pad of claim 1 wherein said removable fastening is by means of an adhesive binder applied to the surface of each of said thin layers facing toward the base layer, said adhesive being selected to be retained on the surface of said layers to which it was applied without leaving upon removal of each layer any significant residue on the surface to which said layers were adhered.

3. The surface treating pad of claim 1 wherein said layer base layer is colored a different color from that of said thin layers.

4. The surface treating pad of claim 1 wherein alternate thin layers are of different colors.

5. The surface treating pad of claim 1 in the shape of a disc.

6. A layered surface treating pad having a plurality of renewable working surfaces comprising in combination:
   (1) a base layer which is about 3 mm to about 13 mm thick and which has a top substantially flat face and a bottom substantially flat face; and
   (2) two stacks, each stack comprising a plurality of thin layers of lofty nonwoven abrasive material, each layer having a thickness in the range of about 0.5 mm to about 20 mm, said layers being adhesively removably fastened to each other in said stack such that a force required to delaminate said layers in use is on the order of 9 to 450 grams per 25 mm width, one of said stacks being adhesively removably fastened to each of said flat faces of said base layer to provide a unitary layered pad which is capable of maintaining such unity during use and which permits each thin layer to be easily separated therefrom to expose a fresh treating surface of the next layer, when desired, without damage to the remainder of the pad.

* * * * *

UNITED STATES PATENT AND TRADEMARK OFFICE

CERTIFICATE OF CORRECTION

PATENT NO. : 4,437,271

DATED : March 20, 1984

INVENTOR(S) : Thomas R. McAvoy

Figure 3:
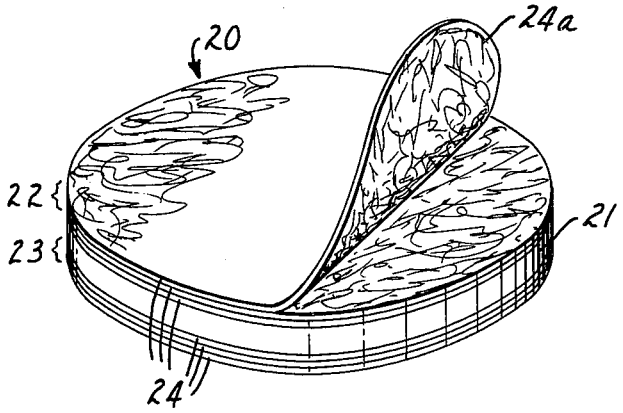
FIG. 3 is a perspective view of another embodiment of a pad made in accordance with the present invention showing the top thin layer of lofty nonwoven abrasive product partly removed from the upper surface thereof.

It is certified that error appears in the above—identified patent and that said Letters Patent is hereby corrected as shown below:

Col. 2, line 53, "FIG. 2" should read --FIG. 3--.

Col. 4, line 40, "remain when" should read --remain in place when--.

Col. 4, line 61, "terypolymer" should read --terpolymer--.

Signed and Sealed this

Tenth Day of July 1984

[SEAL]

Attest:

GERALD J. MOSSINGHOFF

Attesting Officer

Commissioner of Patents and Trademarks